US008276948B2

(12) United States Patent
Uyeda

(10) Patent No.: US 8,276,948 B2
(45) Date of Patent: Oct. 2, 2012

(54) MULTIPLE ACCESS DOOR LOCK MECHANISM WITH REVERSIBLE CAM ACTUATION

(75) Inventor: Alan K. Uyeda, Irvine, CA (US)

(73) Assignee: Adams Rite Manufacturing Co., Phoenix, AZ (US)

( * ) Notice: Subject to any disclaimer, the term of this patent is extended or adjusted under 35 U.S.C. 154(b) by 100 days.

(21) Appl. No.: 12/800,775

(22) Filed: May 24, 2010

(65) Prior Publication Data

US 2011/0285149 A1 Nov. 24, 2011

(51) Int. Cl.

| | |
|---|---|
| ***E05C 7/00*** | (2006.01) |
| ***E05C 9/10*** | (2006.01) |
| ***E05C 1/00*** | (2006.01) |
| ***E05C 19/10*** | (2006.01) |

(52) U.S. Cl. ..... 292/3; 292/7; 292/32; 292/37; 292/124

(58) Field of Classification Search ..... 292/3, 7, 292/32, 37, 124, 132, 98, 159, 165, 169, 292/169.13, 182, 140, 244
See application file for complete search history.

(56) References Cited

U.S. PATENT DOCUMENTS

| | | | | |
|---|---|---|---|---|
| 3,922,896 | A * | 12/1975 | Kagoura | 70/223 |
| 4,596,411 | A * | 6/1986 | Geringer et al. | 292/165 |
| 4,674,776 | A * | 6/1987 | James | 292/40 |
| 5,027,625 | A * | 7/1991 | Krachten | 70/107 |
| 5,228,730 | A * | 7/1993 | Gokcebay et al. | 292/144 |
| 5,474,348 | A * | 12/1995 | Palmer et al. | 292/359 |
| 5,678,870 | A * | 10/1997 | Pelletier | 292/244 |
| 5,876,073 | A * | 3/1999 | Geringer et al. | 292/144 |
| 6,793,253 | B2 * | 9/2004 | Bruwer et al. | 292/144 |
| 7,497,486 | B1 * | 3/2009 | Davis et al. | 292/32 |

* cited by examiner

*Primary Examiner* — Thomas Beach
*Assistant Examiner* — Nathan Cumar
(74) *Attorney, Agent, or Firm* — Woods Oviatt Gilman LLP

(57) ABSTRACT

In combination a door, latch structure at an edge of the door, and independently opens the door latch operating components at opposite sides of the door, displaceable structure in the door having a position blocking movement of the latch structure, first means responsive to displacement of a selected one of the components for displacing the structure from the blocking position to allow movement of the latch structure, for door opening, and the first means including a rotatable cam having reversible positions in each of which motion is transmitted to the displacement structure in response to displacement of the respective components.

20 Claims, 5 Drawing Sheets

MULTIPLE ACCESS DOOR LOCK MECHANISM WITH REVERSIBLE CAM ACTUATION

BACKGROUND OF THE INVENTION

This invention relates generally to ease and reliability of door unlocking mechanisms and more particularly to reliability of access to door unlocking, as from both outside and inside locations, and with use of door handles that rotate in opposite directions to actuate latches.

There is continued need for the above referred to mechanisms, integrated in easily hand operated apparatus, installed in a door, and to allow door handle rotation in either clockwise or counterclockwise direction as determined upon lock installation in a door. There is also need for the simple, reliable, compact combination of elements, functioning as described and producing the improved results as will appear.

SUMMARY OF THE INVENTION

It is a major object of the invention to provide, in combination:

a) a door, latch mechanism at an edge of the door, and door latch operating components at opposite sides of the door, b) displaceable structure in the door having a position blocking movement of the latch mechanism, c) first means responsive to displacement of either of the components for displacing the structure from blocking position to allow movement of the latch mechanism for door opening, and d) said first means including a rotatable cam having reversible positions in each of which motion is transmitted to the displaceable structure in response to displacement of the respective components.

As will be seen, the structure typically includes a slider displaceable in response to operation of said first means, in either of the cam reversible positions, and as the cam is rotated.

As will be seen, the slider is typically movable in response to turning of either of said components to displace the slider, allowing pivoting movement of the latch means, and as the cam is rotated.

Further, the reversible cam allows installation of the lock mechanism to accommodate turning of a door handle clockwise or counterclockwise to open a door, this being referred to as "left handed" or "right handed" operation of a door handle. As will be seen, a spring may be provided to bodily urge the cam in the direction of an axis of cam pivoting, to accommodate cam position reversal, upon installation.

An additional object is to provide a cam that defines a through slot extending between opposite cam sides, the cam having a pivot spaced from the slot, there being a cam actuating pin extending in the slot in each of said reversible cam positions. Typically, the pin is carried by one of the components, in offset relation to an axis of rotation defined by the cam pivot.

Yet another object is to provide for the reversible cam installation and operation, in a lock wherein the slider, as referred to, is operated or displaced either in response to cam selection rotation as referred, or in response to an electrically actuated device, including a solenoid.

A further object is to provide an axis of cam pivoting extending generally normal to the plane of the cam, the cam having a through slot spaced from that axis, there being a cam pivot actuating pin extending in the slot to controllably rotate the cam in response to door handle turning, in each of the reversible positions of the cam. A cam mounting allows bodily axial cam replacement, or release to be reversed in position, and a spring is oriented to resist such bodily axial cam displacement and to yieldably return the cam to operating position in each of such reversible positions.

These and other objects and advantages of the invention, as well as the details of an illustrative embodiment, will be more fully understood from the following specification and drawings, in which:

DRAWING DESCRIPTION

FIG. 1*a* is an elevation showing a door with hinges on the right side, door handle, and lock mechanism in the door;

FIG. 1*b* is an elevation showing the opposite side of the FIG. 1*a* door with hinges on the left side, and a handle and the lock mechanism;

DETAILED DESCRIPTION

Figure 1B:
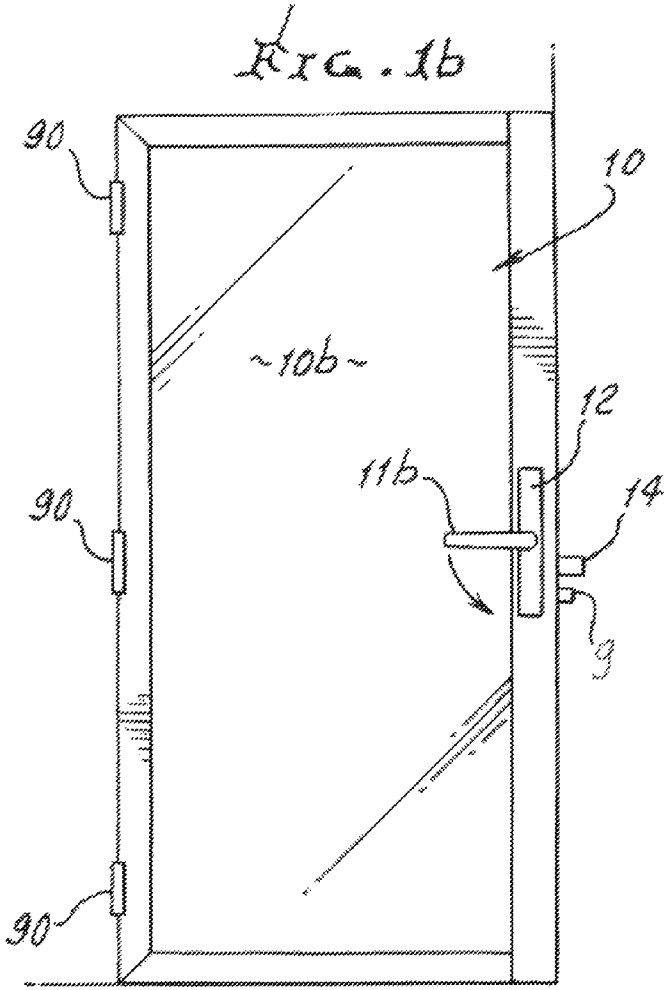
Figure 1A:
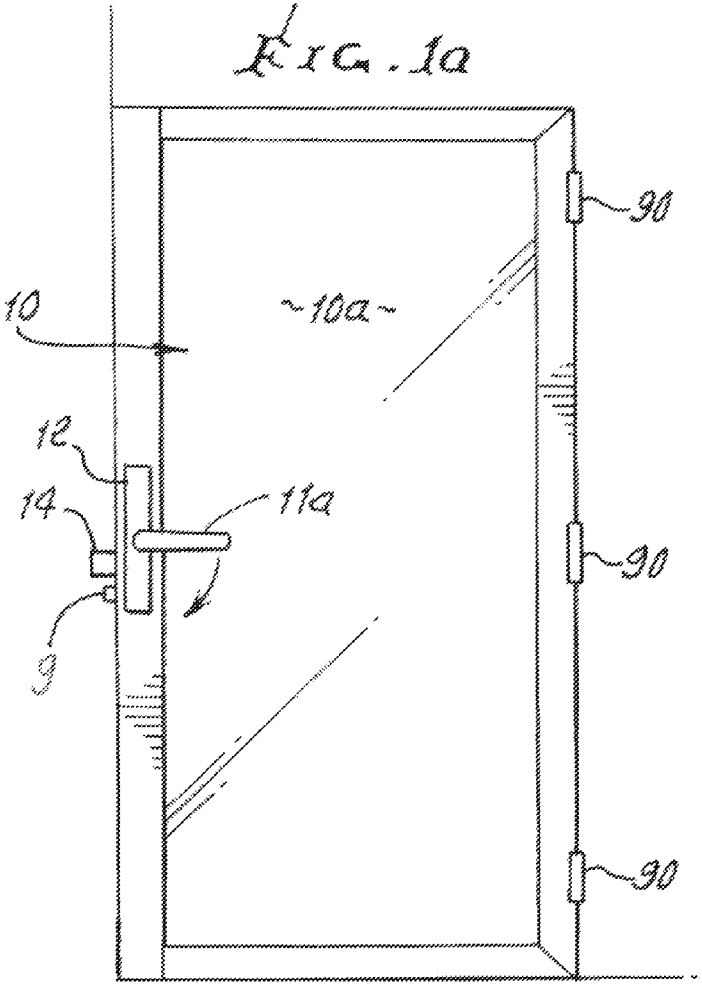

Referring first to FIGS. 1*a* and 1*b*, door 10 has opposite sides 10*a* and 10*b*, handles 11*a* and 11*b* at said respective sides, and a lock mechanism 12 located in the door. Latch structure protrudes form the door edge 13, and may include one or more latches. Two such latches are shown, a main latch 14 and an auxiliary latch 9. Handles 11*a* and 11*b* may comprise one form of door operating components. Door pivots or hinges appear at 90.

Figure 2:
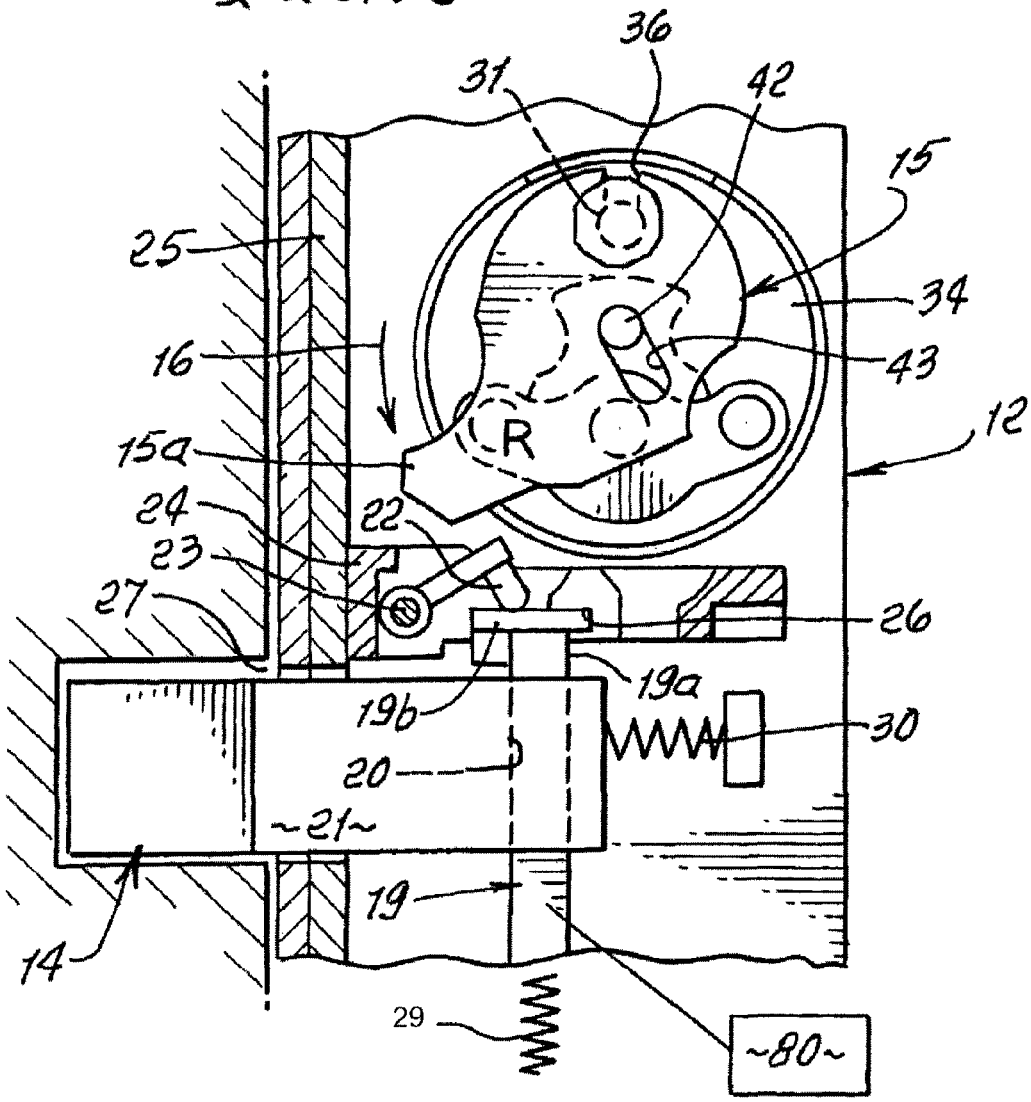
FIG. 2 is an enlarged section taken in elevation through a portion of the lock mechanism; and in relation to a bolt, a reversible cam being shown for counterclockwise rotation.

Extending the description to FIG. 2, displaceable structure is provided in the door, i.e. within the lock mechanism 12 in the door, and has one position blocking movement, i.e. retraction, of the latch structure, typically main latch or bolt 14.

First means is provided to be responsive to displacement of a selected one of the door operating components for displacing the displaceable structure from blocking position, to allow movement of the latch structure, for door opening. Such first means typically includes a rotatable cam 15 having reversible positions (see FIGS. 2 and 5), in each of which motion is transmitted to the displaceable structure in response to displacement of the respective components (for example handles 11*a* and 11*b*). In the example, as a handle is rotated counterclockwise, the cam is rotated counterclockwise in FIG. 2 (see arrow 16), and as a handle is rotated clockwise, the reverse positioned cam is rotated clockwise in FIG. 5 (see arrow 17). Rotation of the cam in FIG. 2 may correspond to right handed rotation of a handle (see latch "R" on the side of the cam), and rotation of the cam in FIG. 5 may correspond to left handed rotation of a handle (see latch "L" on the opposite side of the cam).

The displaceable structure may advantageously comprise a slider 19 having the form of a longitudinally downwardly elongated shaft 19*a*, and a head 19*b* on the shaft to be displaced bodily downwardly in a bore 20 formed in bolt carrier 21. An angled dog 22, pivoted at 23, presses downwardly on head 19*b* as the cam 15 and extension 15*a* are rotated to engage and displace the dog downwardly in FIGS. 2 and 5. The pivot 23 is carried by structure 24 attached to lock frame 25.

As the head 19*b* is displaced downwardly, it releases from pocket 26 in structure 24, to allow the latch bolt to be retracted to the right in response to bolt angled face engagement with wall opening 27, as the door is pushed and swung into open position. When the door is returned to closed position, spring 30 urges the carrier 21 to the left, returning the bolt to the position shown in FIGS. 2 and 5. Also, a spring 29 urges the shaft 19*a* upwardly, returning head 19*b* upwardly into pocket 26, locking the bolt in FIGS. 2 and 5 position.

Figure 3:
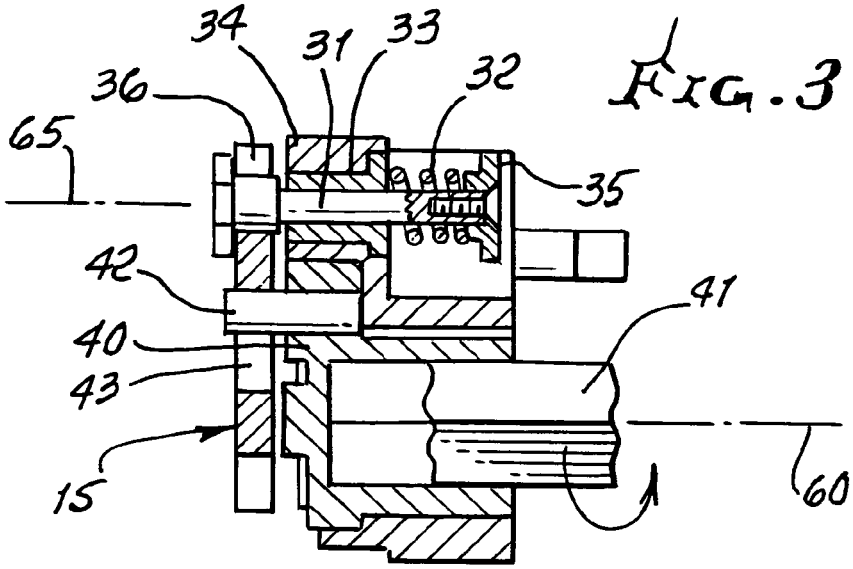
FIG. 3 is an enlarged elevation, taken edgewise of the cam, and showing cam mounting enabling reversal of the cam.
Figure 4:
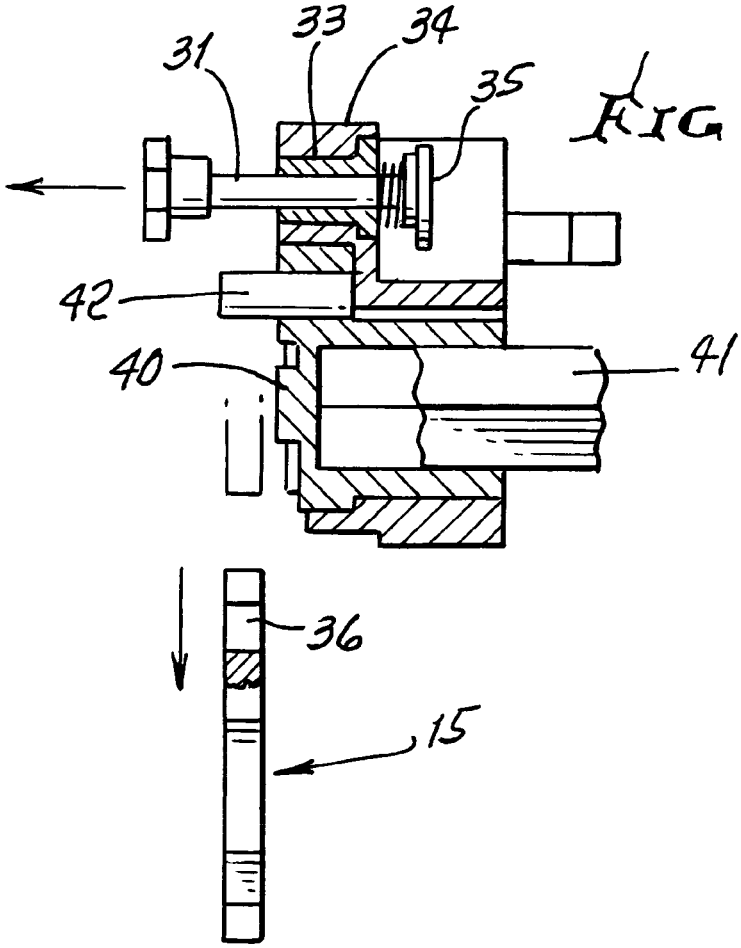
FIG. 4 is a view like FIG. 3, but showing cam removal, as during its reversing.
Figure 5:
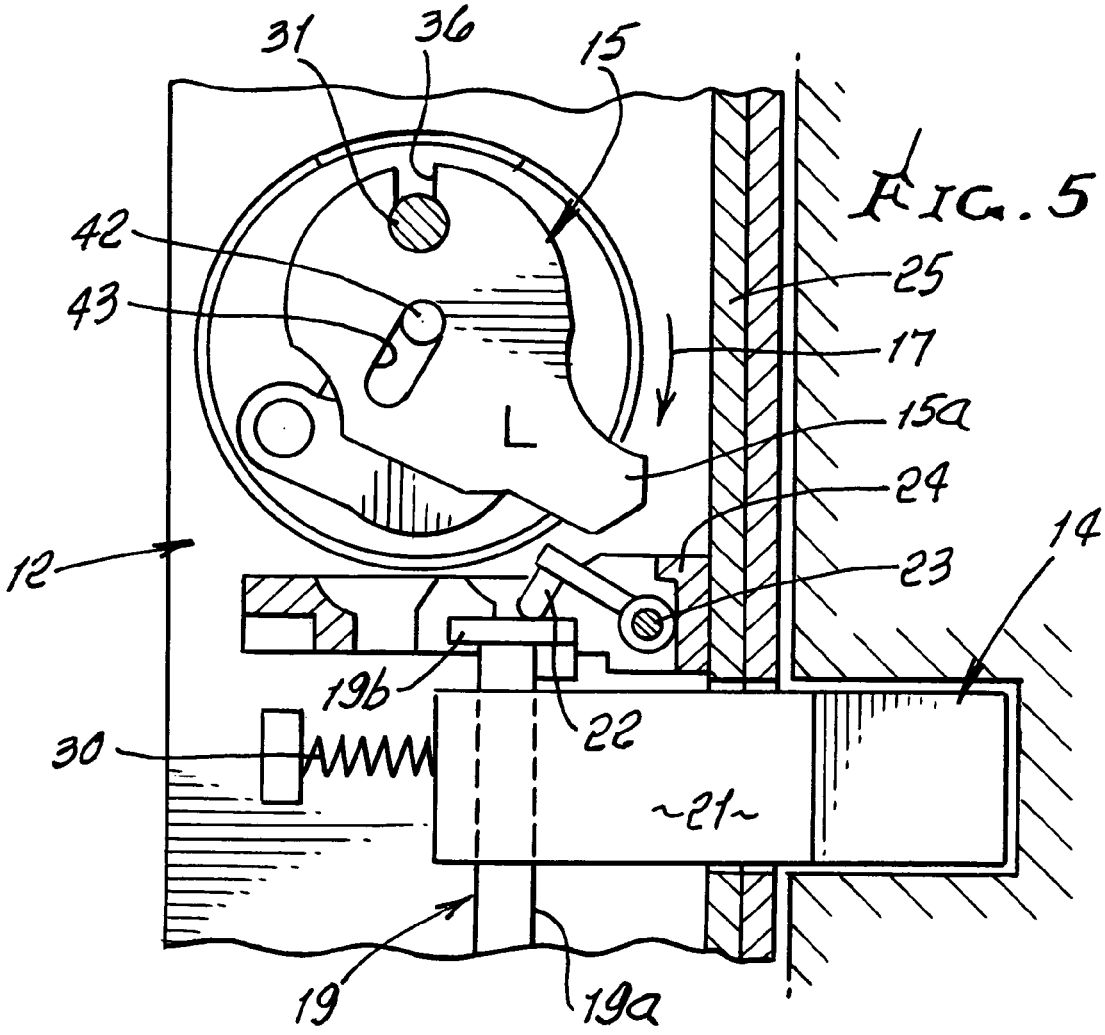
FIG. 5 is a view like FIG. 2 but with the cam mounted in reversed position, to be clockwise rotatable.
Figure 6:
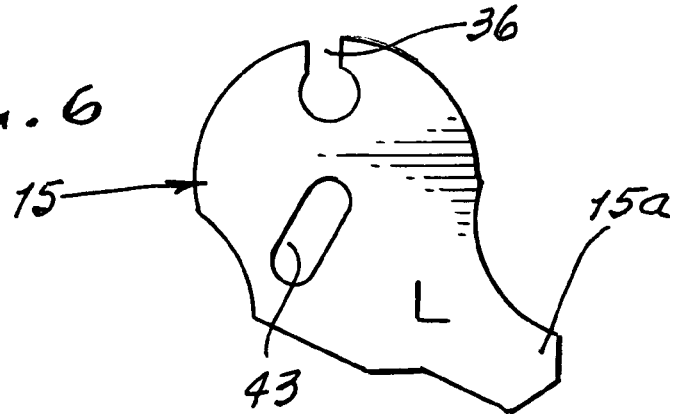
FIG. 6 is a view of the cam, showing details of construction.
Figure 7:
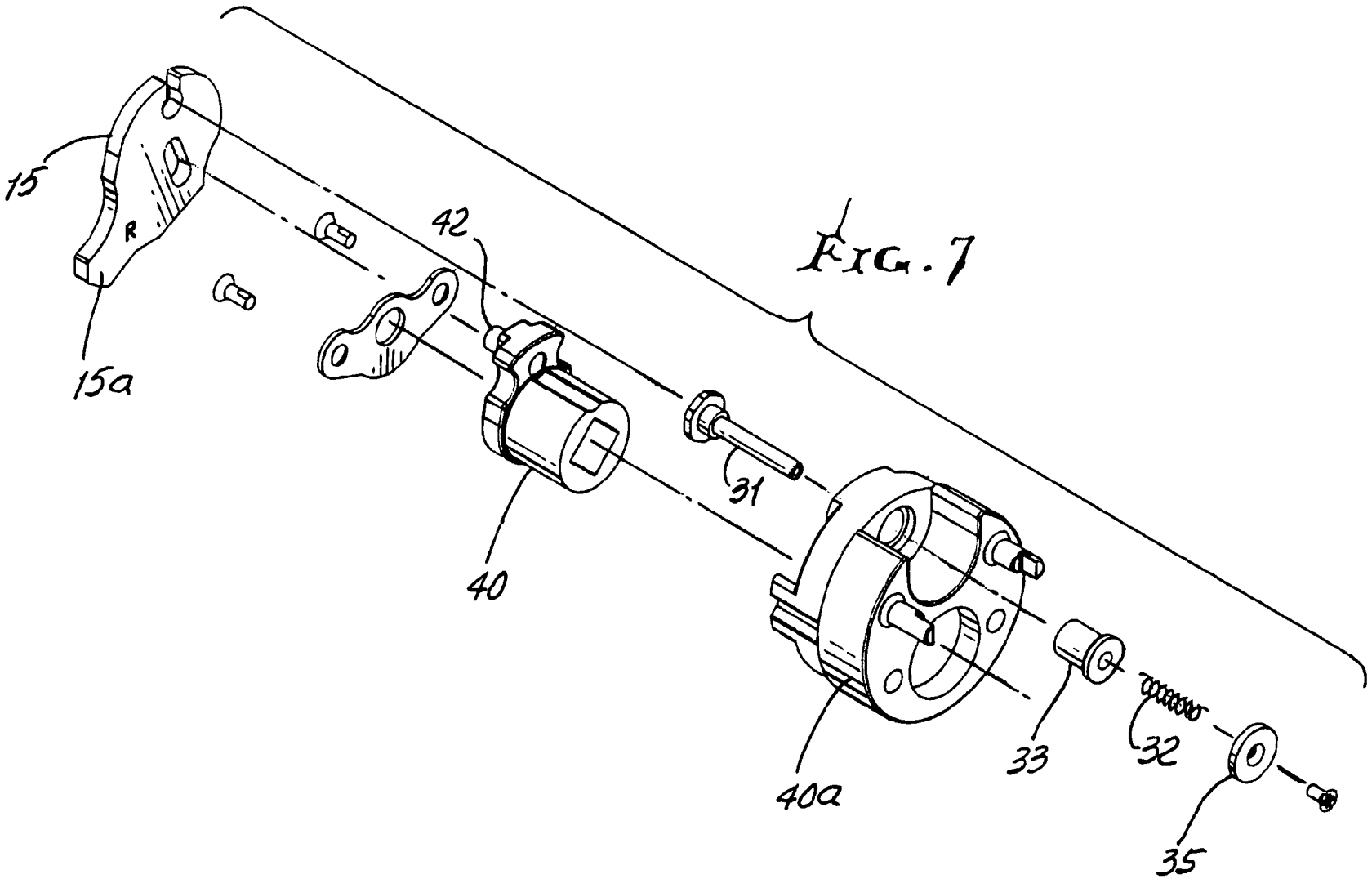
FIG. 7 is an axially exploded perspective view of the preferred cam and associated mechanisms.

Referring to FIGS. 3 and 4, they illustrate reversing of the cam position as between FIGS. 2 and 5. The cam 15 is carried on a pin 31 urged by spring 32 to the right, in FIG. 3. Pin 31 is slidable in a tubular bushing 33 carried by structure 34. A cap 35 on the pin compresses the spring as the cam is manually pulled to the left, for release and reversing of its position, as appears in FIG. 4. A slot 36 in the upper extent of the cam enables cam downward release from the pin, for reversing.

A cam driver 40 is carried on handle shaft 41 to rotate the cam as the handle is turned. A pin 42 carried by the driver is received in a slot 43 in the cam, the slot angled to rotate the cam about pivot axis 65, that extends normal to the plane of the cam as the driver is turned. The pin is carried in offset relation to the axis 60 of rotation defined by the shaft.

Latch or bolt 15 is below the latch 14, and operates in similar manner as latch 14, but is unblocked against retraction. The two latches are mounted to be bodily retracted, and have angled actuating surfaces facing in opposite directions to bear against wall surfaces.

FIG. 2 also schematically shows electrically operable actuating means 80 for effecting displacement of the displaceable structure, including slider 19 from blocking position and allow movement of the latches, for door opening.

I claim:

1. A lock mechanism for being disposed in a lock frame of a door hingedly mounted to a door frame, the lock mechanism being configured for selectively allowing the door to be moved in a door opening direction from a closed position within the door frame, the lock mechanism comprising:

a latch bolt having an opening defined therein, wherein the latch bolt is configured for moving between an extended position and a retracted position, wherein the latch bolt is in the extended position to prevent movement of the door in the door opening direction, and wherein the latch bolt is in the retracted position to allow the door to be moved in the door opening direction;

a slider configured for being moveably positioned within the opening between a blocking position and a release position, wherein the slider prevents movement of the latch bolt from the extended position when in the blocking position, and wherein the slider allows the latch bolt to move to the retracted position when in the release position;

a cam driver rotatably associated with the lock frame about a first pivot axis;

a handle connected to the cam driver; and a cam configured to move the slider to the release position and configured for being selectively connected to the cam driver in one of a first position and a second position, wherein the cam is reversible so that when the cam is connected to the cam driver in the first position the connection allows for the cam to move the slider to the release position when the handle is rotated in a first rotational direction, and so that when the cam is connected to the cam driver in the second position the connection allows for the cam to move the slider to the release position when the handle is rotated in a second rotational direction, wherein the first rotational direction is opposite to the second rotational direction.

2. A lock mechanism in accordance with claim 1, wherein the cam driver includes a cam actuating pin that extends perpendicularly to a plane formed by the cam, and wherein the cam has a slot defined therein that is configured for receiving the cam actuating pin and rotating the cam about a second pivot axis when the cam driver is rotated about the first pivot axis.

3. A lock mechanism in accordance with claim 2, wherein the cam actuating pin extends in a direction that is parallel with the second pivot axis and offset from the second pivot axis.

4. A lock mechanism in accordance with claim 1, further comprising a handle shaft fixedly coupling the handle to the cam driver.

5. A lock mechanism in accordance with claim 2, further comprising a second pin moveably disposed along the second pivot axis between a cam engaging position and a cam releasing position, wherein the second pin pivotally couples the cam to the cam driver in the cam engaging position, and wherein the second pin is configured for allowing the cam to be released from the cam driver in the cam releasing position.

6. A lock mechanism in accordance with claim 5, wherein the slot is a first slot, wherein the cam has a second slot defined in a circumferential edge of the cam, wherein the cam driver has an opening defined therein, and wherein the second pin is configured for being disposed in the second slot and the opening in the cam driver.

7. A lock mechanism in accordance with claim 5, further comprising:

a retaining member coupled with the second pin; and a biasing mechanism disposed between the cam driver and the retaining member for biasing the second pin toward the cam engaging position.

8. A lock mechanism in accordance with claim 1, further comprising an angled dog pivotally associated with the lock frame, the angled dog configured for transferring movement of the cam to the slider to rove the slider to the release position.

9. A lock mechanism in accordance with claim 1, further comprising a biasing mechanism configured for biasing the latch bolt toward the extended position.

10. A lock mechanism in accordance with claim 1, wherein the slider includes an elongated shaft and a head, wherein the elongated shaft extends within the opening defined in the latch bolt, and wherein the head is configured for engaging a pocket associated with the lock frame when the slider is in the blocking position.

11. A lock mechanism in accordance with claim 1, further comprising a biasing mechanism configured for biasing the slider toward the blocking position.

12. A lock mechanism in accordance with claim 1, further comprising an electrically operable actuating mechanism configured for moving the slider to the release position.

13. A lock mechanism in accordance with claim 1, wherein the cam includes an extension, wherein the extension is configured for selectively moving the slider to the release position.

14. A lock mechanism for being disposed in a lock frame of a door hingedly mounted to a door frame, the lock mechanism being configured for selectively allowing the door to be moved in a door opening direction from a closed position within the door frame, the lock mechanism comprising:

a latch bolt having an opening defined therein, wherein the latch bolt is configured for moving between an extended position and a retracted position, wherein the latch bolt is in the extended position to prevent movement of the door in the door opening direction, and wherein the latch bolt is in the retracted position to allow the door to be moved in the door opening direction;

a first biasing mechanism configured for biasing the latch bolt toward the extended position;

a slider configured for being moveably positioned between a blocking position and a release position, wherein the slider prevents movement of the latch bolt from the extended position when in the blocking position, wherein the slider allows the latch bolt to move to the retracted position when in the release position, wherein the slider includes an elongated shaft and a head, wherein the elongated shaft extends within the opening defined in the latch bolt, and wherein the head is configured for engaging a pocket associated with the lock frame when the slider is in the blocking position;

a second biasing mechanism configured for biasing the slider toward the blocking position;

a cam having a first slot and a second slot defined therein, the second slot being defined in a circumferential edge of the cam;

a cam driver rotatably associated with the lock frame about a first pivot axis, wherein the cam is configured to rove the slider to the release position and configured for being selectively connected to the cam driver about a second pivot axis in one of a first position and a second position, wherein the cam driver includes a cam actuating pin extending in a direction that is perpendicular to a plane formed by the cam, parallel with the second pivot axis, and offset from the second pivot axis, wherein the first slot defined in the cam is configured for receiving the cam actuating pin and rotating the cam about the second pivot axis when the cam driver is rotated about the first pivot axis, and wherein the cam driver has an opening defined therein;

a handle fixedly coupled with the cam driver;

an angled dog pivotally associated with the lock frame, the angled dog configured for transferring the rotational movement of the cam about the second pivot axis to the slider to move the slider to the release position;

a second pin configured for being moveably disposed in the second slot and the opening defined in the cam driver along the second pivot axis between a cam engaging position and a cam releasing position, wherein the second pin pivotally couples the cam to the ca driver n the cam engaging position, and wherein the second pin is configured for allowing the cam to be released from the cam driver in the cam releasing position;

a retaining member coupled with the second pin;

a third biasing mechanism disposed between the cam driver and the retain member for biasing the second pin toward the cam engaging position, wherein the cam is reversible so that when the cam is connected to the cam driver in the first position the connection allows for the cam to move the slider to the release position when the handle is rotated in a first rotational direction, and so that when the cam is connected to the cam driver in the second position the connection allows for the cam to move the slider to the release position when the handle is rotated in a second rotational direction, wherein the first rotational direction is opposite to the second rotational direction.

15. A method of installing a lock mechanism in a lock frame of a door that is hingedly mounted to a door frame, the lock mechanism being configured for selectively allowing the door to be moved in a door opening direction from a closed position within the door frame, the method comprising:

providing a latch bolt moveably positioned within the door between an extended position and a retracted position, wherein the latch bolt is in the extended position to prevent movement of the door in the door opening direction, wherein the latch bolt is in the retracted position to allow the door to be moved in the door opening direction, and wherein the latch bolt has an opening defined therein;

providing a slider moveably positioned within the latch bolt opening between a blocking position and a release position, wherein the slider prevents movement of the latch bolt from the extended position when in the blocking position, and wherein the slider allows the latch bolt to move to the retracted position when in the release position;

providing a cam driver rotatably associated with the lock frame about a first pivot axis;

providing a handle connected to the cam driver; and pivotally connecting a reversible cam to the cam driver about a second pivot axis, wherein he reversible cam is configured to move the slider to the release position and configured for being selectively connected to the cam driver in one of a first position and a second position, wherein the reversible cam is pivotally connected to the cam driver in the first position so that the cam moves the slider to the release position when the handle is rotated in a first rotational direction, and wherein the reversible cam is pivotally connected to the cam driver in the second position so that the cam moves the slider to the release position when the handle is rotated in a second rotational direction, wherein the first rotational direction is opposite to the second rotational direction.

16. A method in accordance with claim 15, wherein the cam driver includes a cam actuating pin that extends in a direction that is perpendicular to a plane formed by the reversible cam, and wherein the reversible cam has a slot defined therein that is configured for receiving the cam actuating pin and rotating the reversible cam about the second pivot axis when the cam driver is rotated about the first pivot axis.

17. A method in accordance with claim 16, wherein the cam actuating pin extends in a direction that is parallel with the second pivot axis and offset from the second pivot axis.

18. A method in accordance with claim 16, further comprising:

providing a second pin moveably disposed along the second pivot axis between a cam engaging position and a cam releasing position;

pivotally connecting the reversible cam to the cam driver using the second pin when the second pin is in the cam engaging position; and releasing the reversible cam from the cam driver when the second pin is in the cam releasing position thereby allowing the reversible cam to be interchanged between the first and second positions.

19. A method in accordance with claim 18, wherein the slot is a first slot, wherein the reversible cam has a second slot defined in a circumferential edge of the reversible cam, wherein the cam driver has an opening defined therein, and wherein the second pin is configured for being disposed in the second slot and the opening in the cam driver.

20. A method in accordance with claim 18, further comprising:

providing a retaining member coupled with the second pin;

providing a biasing mechanism disposed between the cam driver and the retaining member; and biasing the second pin toward the camp engaging position using the biasing mechanism.

* * * * *